US007661151B2

(12) United States Patent
Pienaar

(10) Patent No.: US 7,661,151 B2
(45) Date of Patent: Feb. 16, 2010

(54) HAIR AND SCALP PARASITE ERADICATION

(76) Inventor: Marthinus Pienaar, 30 Joubert Street, Potchefstroom (ZA) 2522

( * ) Notice: Subject to any disclaimer, the term of this patent is extended or adjusted under 35 U.S.C. 154(b) by 0 days.

(21) Appl. No.: 11/797,661

(22) Filed: May 7, 2007

(65) Prior Publication Data

US 2008/0276954 A1 Nov. 13, 2008

Related U.S. Application Data

(60) Provisional application No. 60/800,580, filed on May 16, 2006.

(51) Int. Cl.
*A42C 5/04* (2006.01)
*A45D 44/12* (2006.01)
*A61F 13/00* (2006.01)

(52) U.S. Cl. ..... 2/171.2; 2/171.4; 2/171.5; 2/174; 604/304; 604/305; 604/308

(58) Field of Classification Search ..... 604/304, 604/289, 305, 308; 2/171.2, 171.3, 171.5, 2/174

See application file for complete search history.

(56) References Cited

U.S. PATENT DOCUMENTS

| | | | | | |
|---|---|---|---|---|---|
| 3,916,917 | A * | 11/1975 | Hubbert | 132/212 |
| 4,074,369 | A * | 2/1978 | Harmon | 4/518 |
| 4,361,158 | A * | 11/1982 | Baker | 132/212 |
| 5,099,865 | A * | 3/1992 | Flannery et al. | 132/212 |
| 5,235,709 | A * | 8/1993 | Terlep | 4/515 |
| 5,599,485 | A * | 2/1997 | Obermayer | 261/107 |
| 5,644,799 | A * | 7/1997 | Armenta et al. | 2/209.13 |
| 5,685,018 | A * | 11/1997 | West | 2/174 |
| 6,083,209 | A * | 7/2000 | Marasco, Jr. | 604/290 |
| 6,351,852 | B1 * | 3/2002 | Propp | 2/174 |
| 6,432,077 | B1 * | 8/2002 | Stenzler | 604/23 |
| 6,820,283 | B2 * | 11/2004 | Graneto, III | 2/171.2 |
| 6,875,437 | B2 * | 4/2005 | Yanovsky et al. | 424/401 |
| 6,996,853 | B2 * | 2/2006 | Gabriel | 2/174 |
| 2005/0156065 | A1 * | 7/2005 | Eliasson | 239/589 |

* cited by examiner

*Primary Examiner*—Tatyana Zalukaeva
*Assistant Examiner*—Susan Su

(57) ABSTRACT

A hair and scalp covering shield in the form of a flexible bag 10 is shaped to firmly cover the hair and scalp of a person intended for exposure to a hair louse treatment routine. The inlet 14 to the bag 10 in fitted with an elastic band 16. The bag 12 is fitted with an aperture in the form of a hole 24 incorporating a non-return closure type facility 18 to enable the charging of agent to a treatment zone 26 formed within the bag 12 once in use. Treatment of hair lice is effected by starving the treatment zone 26 of oxygen in response to introducing oxygen deficient agent into the zone 26 once the bulk of air has been removed.

9 Claims, 2 Drawing Sheets

2(a)

2(b)

HAIR AND SCALP PARASITE ERADICATION

CROSS REFERENCE TO RELATED APPLICATIONS

Not applicable

BACKGROUND TO THE INVENTION

Figure 1:
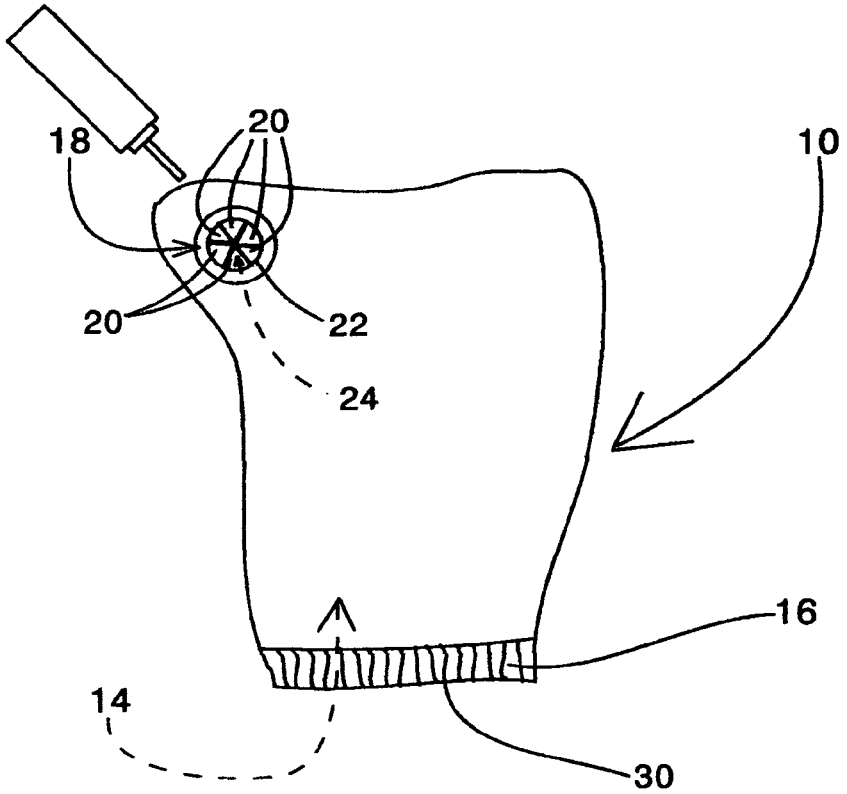

This application claims priority from USA Provisional Application No. 60/800,580 filed on May 16, 2006.

The treatment of hair and scalp related parasitical problems, and especially head lice, is conventionally done by way of a washing action in which a chemical agent is washed into the hair and onto the scalp. As this medium is quite toxic such treatment cannot be done on a regular intermittent basis for the sake of the health of the person being treated. As the function of the conventional agent is to eliminate lice as such, unhatched eggs and nit can only be dealt with once hatched thus requiring a treatment program. As said, the toxicity of the agent serves as a restriction on such washing program in turn restricting its effectiveness. A further problem experienced with the present way of treatment is that it requires substantial effort to prevent agent from reaching the eyes, ears, mouth and perhaps other faculties of the person being treated. This is especially cumbersome in the case of smaller children. Even if the hair and scalp of a person being so treated is covered, liquid agent, as properly wetting such hair and scalp, cannot effectively be fully contained within a covering zone. While during conventional treatment the agent must be maintained on the hair and scalp for a length of time to be effective this immobilises the person undergoing such delicing treatment. It is, amongst others, an object of this invention to address these drawbacks.

BRIEF SUMMARY

This invention deals with a hair and scalp covering shield, a hair and scalp treatment kit and a method for use, amongst others, to treat hair and scalp for parasitical conditions and especially head lice. While the various aspects of the invention are described in particular detail for dealing with the parasitical condition of head lice it will be appreciated that it is not necessarily so limited but can find application in the case of other hair and scalp related problems that can be similarly treated.

DRAWING FIGURES

Figure 3:
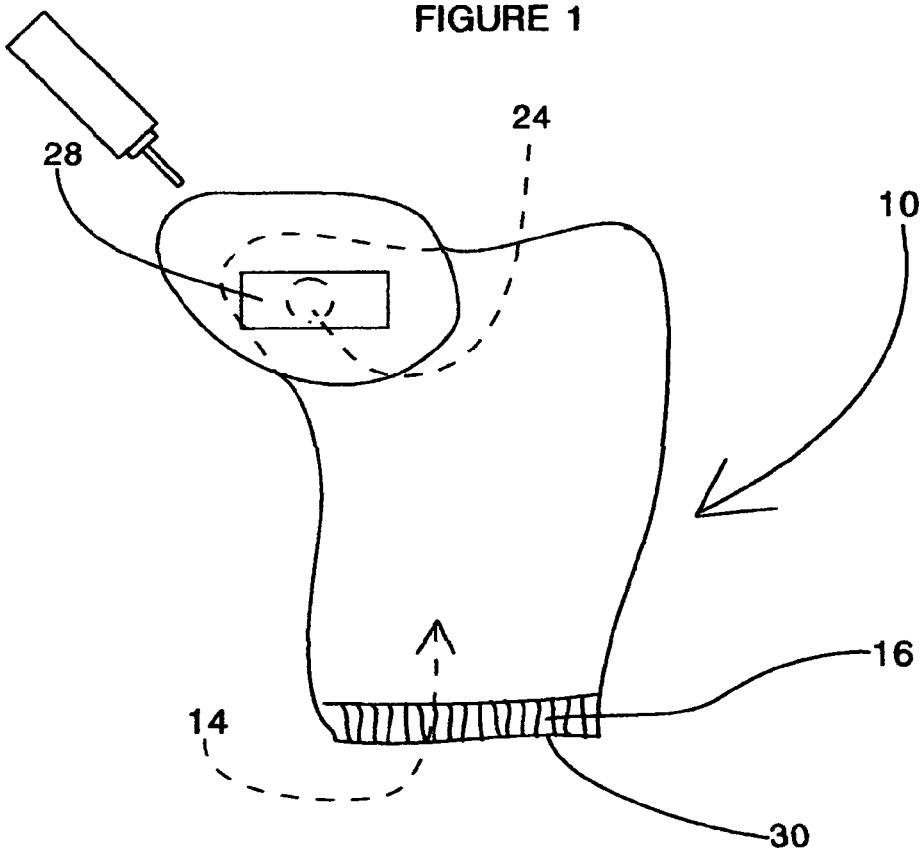
Figure 2:
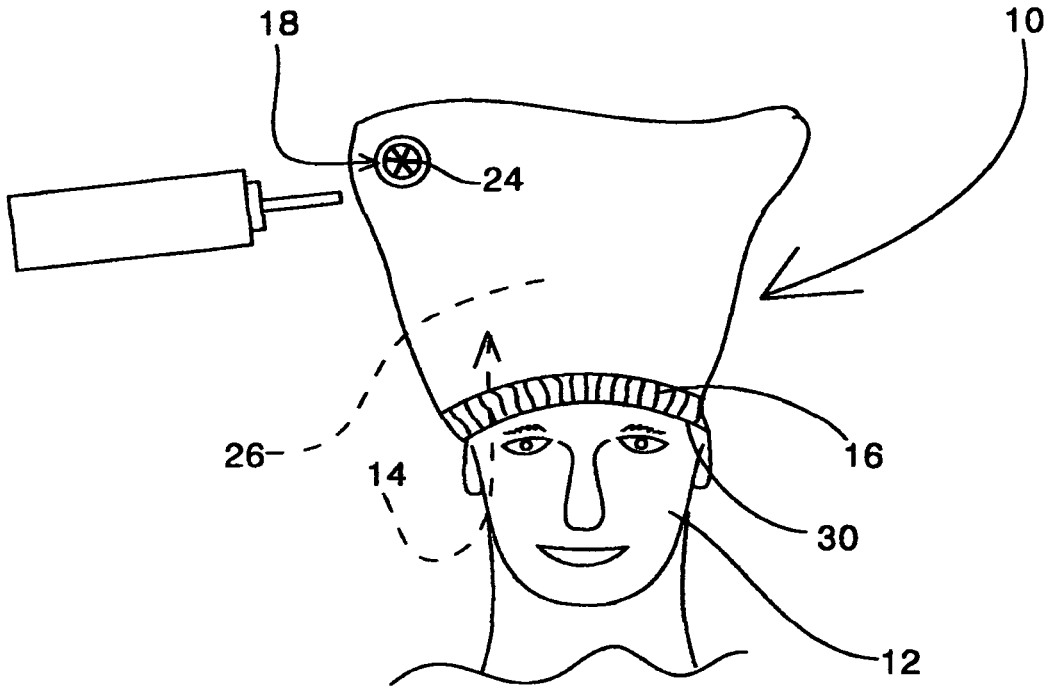
Figure 2:
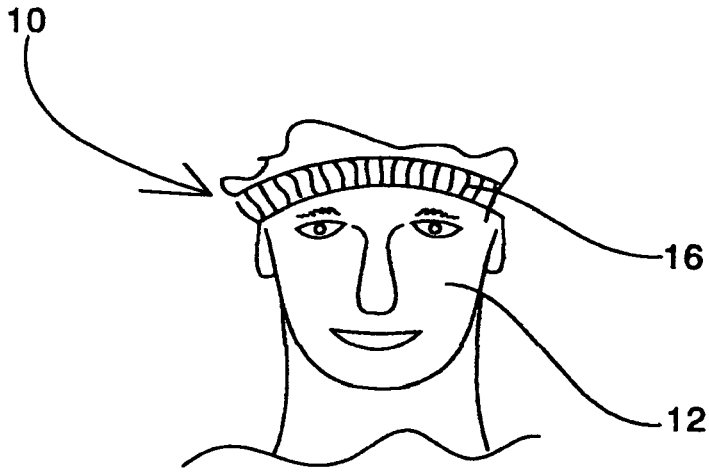

The invention is now described in more detail, by way of example, with reference to the accompanying drawings. In the drawings:

FIG. 1 shows a hair and scalp-covering shield forming part of a hair and scalp treatment kit for treating hair and scalp parasites, particularly, head lice, in the form of a flexible cover as provided by hair and scalp coverable bag, FIG. 2 diagrammatically shows the bag during use, and FIG. 3 shows in a partly cut away view a developed embodiment of the bag used in conjunction with lice eradicating agent.

DETAILED DESCRIPTION OF THE INVENTION

Referring to the drawings a hair and scalp-covering shield, being one aspect of the invention, forming part of a hair and scalp treatment kit, forming another aspect of the invention, for treating hair and scalp parasites, particularly, head lice, in the form of a flexible cover as provided by hair and scalp coverable bag is generally indicated by reference numeral 10.

The bag 10 is shaped to fit against at least substantial gaseous and/or vapour type agent escape onto the hair and scalp of the head 12 of a person intended for exposure to a hair and scalp louse treatment routine by being fitted along the inlet 14 of the bag with an elastic band 16 or being otherwise elastically formed while further incorporating an agent-charging aperture formed to limit agent escape by being in the form of an at least generally non-return closure type facility 18.

As shown in FIG. 1 the closure type facility 18 is in the form of a series of circumferentially arranged resilient flaps 20 narrowing to a common centre from the circumferential edge 22 of a hole 24 through the wall of the bag 10. The flaps 20 are thus secured along their bases to the body of the bag 10 while their apexes meet at the centre of the hole 24. The facility 18 is opened by simply fitting the nozzle of an agent container (not shown) into the hole 24 in the process urging the flaps out of their common plane. As the flaps 20 can flex in either direction the closure 18 also contributes to expelling of air from a treatment zone 26 formed intermediate the head of a user and the bag 10 once fitted for use as discussed more extensively below with reference to FIG. 2. While the closure action of the closure type facility 18 is not critical in the sense of having to fully seal off the zone 26 any suitable mechanism for achieving the desired function can be used.

In specifically referring to FIG. 3 and in a developed embodiment where a liquid agent is used, the bag 10 is fitted with agent absorbing and releasing means in the form of a sponge 28 straddling the inside of the hole 24 in such a way that agent injected into the zone 26, once the bag 10 is fitted for use, is absorbed by the sponge 28 for gradual evaporative release. The sponge 28 is formed with a central recess (not shown) to accommodate the flaps 20 on insertion of the nozzle of an agent-carrying container into the hole 24.

The invention also extends to a hair and scalp treatment kit comprising the bag 10 and an agent-releasing device in the form of a conventional nozzle fitted pressurised container (not shown) containing user non-detrimental parasite eradicating agent in the form of, for example, pressurised butane or alcohol or carbon dioxide or a combination of these components. The butane or alcohol or carbon dioxide thus serves the purpose of air diluting medium for adequately diluting any remaining air in the zone 26 once the bulk of air has been squeezed from it to render the environment of the treatment zone 26 effectively oxygen deficient once the kit is in use. The agent, in whichever effective form, can be supplemented with a suitable deodorant.

While the kit is described in conjunction with its use for eradicating head lice it will be appreciated that it is not limited to such use only.

In use and referring more particularly to FIG. 2 the bag 10 is simply positioned onto the head 12 of the person intended for treatment, as shown in FIG. 2(*a*) in forming the treatment zone 26, with its elastic band 16 running below the hairline along the forehead, the ears and at the back the upper neck of such person in general enclosing the person's scalp and hair.

As shown in FIG. 2(*b*) the bulk of air is then ejected from the zone 26 by simply manually squeezing the bag 10 down onto the head 12 of the user resulting in air becoming expelled between the edge 30 of the bag 10 and the head 12 of the person and also via the closure type facility 18, as already discussed.

The next step involves the charging of agent into the zone 26 via the hole 24 with the use of the pressurised container. When in the form of the gaseous medium described above the agent is simply released into the zone 26. When of liquid character the embodiment of FIG. 3 is conveniently used promoting the progressive release of agent into the zone 26 by the body heat of the head 12. The charging of agent to the zone 26 has the effect of ballooning the bag 10 again, perhaps even to the condition of FIG. 2(*a*).

With the agent working on the basis of oxygen removal its large volumetric extent, once charged to the zone 26, as compared to any remaining air, effectively removes all oxygen from the zone 26. Head lice quickly die off owing to becoming starved of oxygen.

Final removal of parasite remains is achieved by simply brushing it from the hair and scalp once the bag 10 has been removed and conventionally washing the hair and scalp where required. While unhatched eggs and nit may remain on the hair and scalp after a treatment routine it may have to be repeated to render the hair and scalp fully free of head lice. As chemicals that are non-toxic to hair and scalp are used such repetitions will not be detrimental to the health of the person being treated.

An advantage of the invention is found in its convenience and safety of application even by way of repetitions as compared to the toxicity of the conventional technique, as discussed above. This is enhanced by the fact that the object of the function and the equipment of the invention are to starve and environment of oxygen and not to be worked into hair. While the agent, at least once performing its function, is in the form of a gas or vapour the eyes, ears and mouth of a person being treated is not exposed to a flow of liquid agent.

As regards its convenience the advantage is found in the retained mobility of the person undergoing the treatment as such person's scalp and hair remains substantially dry during treatment.

I claim:

1. A hair and scalp covering shield for use in treating hair and scalp by an agent against parasitical conditions, the shield comprising:

a flexible cover presenting a resilient edge region that fits around the hair and scalp of a user, a treatment zone formed between said flexible cover and the scalp of the user;

an agent-charging aperture formed in the flexible cover, said aperture comprising a non-return closure member in the form of a series of circumferentially arranged resilient flaps narrowing to a common center from the circumferential edge of a hole through the cover, wherein the closure is openable by urging the flaps out of their common plane;

a means for absorbing and releasing a hair and scalp treating agent, wherein said means is situated on the treatment zone side of said aperture;

wherein, when in operative use, said flexible cover is formed to collapsibly cover the user's hair and scalp without impairing other head-associated bodily functions;

wherein said flexible cover is configured to permit, in response to an exertion of manual pressure, the expelling of the bulk of air from said treatment zone through said aperture after the flexible cover is operatively fitted to the head of the user;

wherein said fitting is of adequate tightness to at least substantially limit escape of said agent once the cover is in operative use;

wherein said aperture is configured to allow, with the resilient edge of the cover, pressurization of said treatment zone when said treatment zone is charged with said agent; and wherein said agent-absorbing and releasing means is configured to allow distribution of said agent in response to body heat generated inside the treatment zone when the flexible cover is in operative use.

2. The hair and scalp covering shield of claim 1 in which the cover is in the form of a bag sized to fit the hair and scalp of a user in a collapsible and expandable fashion.

3. The hair and scalp covering shield of claim 1 in which the means for absorbing and releasing said scalp treating agent is in the form of a sponge.

4. A hair and scalp treatment kit for use in treating hair and scalp by an agent against parasitical conditions, the kit comprising:

a shield including:

a flexible cover presenting a resilient edge region that fits around the hair and scalp of a user, a treatment zone formed between said flexible cover and the head of the user;

an agent-charging aperture formed in the flexible cover, said aperture comprising a non-return closure member in the form of a series of circumferentially arranged resilient flaps narrowing to a common center from the circumferential edge of a hole through the cover, wherein the closure is openable by urging the flaps out of their common plane;

a means for absorbing and releasing a parasite-eradicating agent, wherein said means is situated on the treatment zone side of said aperture;

wherein, when in operative use, said flexible cover is formed to collapsibly cover the user's hair and scalp without impairing other head-associated bodily functions;

wherein said flexible cover is configured to permit, in response to an exertion of manual pressure, the expelling of the bulk of air from said treatment zone through said aperture after the flexible cover is operatively fitted to the head of the user;

wherein said fitting is of adequate tightness to at least substantially limit escape of said agent once the cover is in operative use;

wherein said aperture is configured to allow, with the peripheral closing off type fitting of the cover, pressurization of said treatment zone when said treatment zone is charged with said parasite-eradicating agent;

wherein said agent-absorbing and releasing means is configured to allow distribution of said agent in response to body heat generated inside the treatment zone when the flexible cover is in operative use;

and an agent-releasing device configured to release said agent into said treatment zone via the aperture, wherein during operative use, said agent-releasing device charges said agent into the treatment zone once the bulk of air has been manually squeezed therefrom.

5. The kit of claim 4, wherein the parasite-eradicating agent is an air diluting medium configured to dilute the remaining air in the treatment zone once the bulk of air has been removed, to render the treatment zone at least substantially oxygen deficient when the kit is in use.

6. The kit of claim 5, wherein the air diluting medium is selected from a group consisting of alcohol, butane, carbon dioxide, and a combination thereof.

7. The kit of claim 5, wherein the agent-releasing device is in the form of a pressurized container of which the discharge nozzle is formed to fit through the aperture of the cover.

8. The kit of claim 4 in which the cover is in the form of a bag sized to fit the hair and scalp of a user in a collapsible and expandable fashion.

9. The kit of claim 4 in which the means for absorbing and releasing said parasite-eradicating agent is in the form of a sponge.

* * * * *